US005104345A

United States Patent [19]

Lyman

[11] Patent Number: 5,104,345

[45] Date of Patent: Apr. 14, 1992

[54] TOY CONSTRUCTION SET FORMED FROM PLURAL BUILDING BLOCKS

[76] Inventor: Ronald L. Lyman, 11140 Squanan River Ct., Rancho Cordova, Calif. 95670

[21] Appl. No.: 491,081

[22] Filed: Mar. 9, 1990

[51] Int. Cl.[5] ..... A63H 33/08

[52] U.S. Cl. ..... 446/101; 446/114; 446/117

[58] Field of Search ..... 446/101, 99, 97, 114, 446/113, 116, 117, 128

[56] References Cited

U.S. PATENT DOCUMENTS

| | | | |
|---|---|---|---|
| 171,533 | 12/1875 | Schmetzer | 446/101 |
| 1,405,851 | 2/1922 | Lewis . | |
| 1,554,095 | 9/1925 | Hultman . | |
| 2,776,521 | 1/1957 | Zimmerman . | |
| 2,972,833 | 2/1961 | Grutta . | |
| 3,005,282 | 10/1961 | Christiansen . | |
| 3,162,973 | 12/1964 | Christiansen . | |
| 3,242,610 | 3/1966 | Christiansen . | |
| 3,392,480 | 7/1968 | Stubbmann | 446/101 X |
| 3,496,670 | 2/1970 | Sloop et al. . | |
| 3,603,025 | 9/1971 | Heubl . | |
| 3,604,145 | 9/1971 | Zimmerman . | |
| 3,740,895 | 6/1973 | Nagasaka | 446/101 X |
| 3,894,354 | 7/1975 | Crawley . | |
| 3,895,456 | 7/1975 | Fabre . | |
| 4,055,019 | 10/1977 | Harvey . | |
| 4,090,322 | 5/1978 | Hake . | |
| 4,185,410 | 1/1980 | Kristiansen . | |
| 4,214,403 | 7/1980 | Knudsen . | |
| 4,253,268 | 3/1981 | Mayr . | |
| 4,606,732 | 8/1986 | Lyman | 446/120 |
| 4,642,064 | 2/1987 | Yoke | 446/101 X |
| 4,731,041 | 3/1988 | Ziegler | 446/128 X |
| 4,764,144 | 8/1988 | Lyman | 446/128 |
| 4,789,369 | 12/1988 | Lyman | 446/101 |

FOREIGN PATENT DOCUMENTS

| | | |
|---|---|---|
| 109181A | 5/1984 | European Pat. Off. . |
| 2534481A | 4/1984 | France . |
| 1167678 | 10/1969 | United Kingdom . |
| 1382134 | 1/1975 | United Kingdom . |

*Primary Examiner*—Mickey Yu
*Attorney, Agent, or Firm*—Bernhard Kreten

[57] ABSTRACT

A construction toy configured as a humanoid figurine formed from: a torso having a front wall and a rear wall, a head area, downwardly extending legs and outwardly extending arms. The torso and its front and rear walls provide first and second attachment surfaces which are complementally formed mirror images, one of the other so as to provide connecting elements when the figurines are to be stacked and interconnected. Because the nature of the attachment surfaces is neutral with respect to its center, the connecting elements can also allow attachment to an adjacent stack of figurines in a rotational pattern. The connecting elements also allows quadrans of the torso to be stacked forming imbrications. The head has a profile provided with a first fastening elements for interconnection with either the second attachment surface or other fastening elements. Each leg is formed from two pieces of planar stock spaced one from the other defining a groove. The groove defines a second fastening elements. Each leg is spaced one from the other with a gap defining a third fastening elements. Each arm is provided with a peripheral extemity defining a fourth fastening elements. Each arm is provided on a front surface thereof with a pair of spaced locking ribs defining a fifth fastening elements. Each back surface of the arm is provided with a locking tab providing a sixth fastening elements.

21 Claims, 2 Drawing Sheets

TOY CONSTRUCTION SET FORMED FROM PLURAL BUILDING BLOCKS

FIELD OF THE INVENTION

The following invention relates generally to an instrumentality for creating objects of amusement for children formed from a plurality of building blocks. The blocks are interconnected such that they stimulate a child's imagination and creativity to form structures and more specifically, structures which include participation by a fanciful robotic figurine construction toy.

BACKGROUND OF THE INVENTION

The instant invention reflects an ongoing evolution of structure, disclosed in U.S. application Ser. No. 07/419,095 filed Oct. 10, 1989, to the instant inventor.

The prior art is relatively rich in attempts at providing construction blocks for children which challenge the child's imagination yet are not so complex as to frustrate the child in his creative endeavors. Not surprisingly, many known patents can be grouped into the above noted objection categories as being either too simple or too complex.

The following patents reflect the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | PATENT NO. | ISSUE DATE |
|---|---|---|
| Bersani | FR2534-481-A | 4/20/84 |
| Inskip | EP-109-181-A | 5/23/84 |
| Playcraft Toys, Inc. | BR1,167,678 | 10/22/69 |
| Retzler & Knight | BR1,382,134 | 1/29/75 |
| Frederick W. Lewis | 1,405,851 | 2/7/22 |
| Hultman | 1,554,095 | 9/15/25 |
| Zimmerman | 2,776,521 | 1/8/57 |
| Grutta | 2,972,833 | 2/28/61 |
| Christiansen | 3,005,282 | 10/24/61 |
| Christiansen | 3,162,973 | 12/29/64 |
| Christiansen | 3,242,610 | 3/29/66 |
| Sloop, et al. | 3,496,670 | 2/24/70 |
| Heubl | 3,603,025 | 9/7/71 |
| Zimmerman | 3,604,145 | 9/14/71 |
| Crawley | 3,894,354 | 7/15/75 |
| Fabre | 3,895,456 | 7/22/75 |
| Hake | 4,090,322 | 5/23/78 |
| Harvey | 4,055,019 | 10/25/77 |
| Kristiansen | 4,185,410 | 1/29/80 |
| Knudsen | 4,214,403 | 7/29/80 |
| Mayr | 4,253,268 | 3/3/81 |
| Lyman | 4,606,732 | 8/19/86 |
| Lyman | 4,764,144 | 8/16/88 |
| Lyman | 4,789,369 | 12/6/88 |

SUMMARY OF THE INVENTION

In general, the instant invention shares many of the attributes of applicant's earlier filed application.

The instant invention is also distinguished over the known prior art in a plurality of ways. In general, the blocks forming the instant invention assume a substantially wafer-like configuration having a top surface and a bottom surface. The top surface is effectively the complement of the bottom surface and visa versa. That is, each surface is formed with a series of projections and recesses. The recesses on one surface define the projections on the other surface. In this manner, all similar blocks thus formed are capable of being stacked and locked one on top of the other.

In practice, the projections and associated recesses defining the top and bottom surfaces are oriented such that a plurality of radially extending vanes are provided on one surface and the complemental recesses on the opposite surface are provided between a plurality of radially extending wedges. Because of this symmetry, each block has a "radiance" when viewing the top and bottom surfaces of the wafer-shaped building block. By "radiance" it is meant to connote a center having radially diverging lines.

The wedges on one side, having recesses spaced therebetween and extending radially define a first attachment means. Corresponding vanes on an opposite side, extending radially and formed where the recesses appear on the first side, define second attachment means. Collectively, the first and second attachment means define connecting means so that front and rear surfaces can be interconnected.

Besides the top and bottom surfaces being inverse images of one another, each wafer-shaped building block includes a peripheral side wall circumscribing the block provided with a further means for interconnecting adjacent blocks. The interconnection means generally embraces one of two forms: either a projection or a channel.

In general the construction toy of the instant invention is configured as a substantially humanoid figurine. This means that a head area, provided for on the wafer, also defines a first fastening means. A pair of arms and pair of legs also extend outwardly from the human torso defined by the central vane and wedge area. The arms and legs have means defining second through sixth fastening means.

The head itself is configured with a curved profile having general facial features and defining a first fastening means. The legs, defined by two pairs of planar material, are configured to provide the second and third fastening means. The arms extend outwardly from a central torso portion and collectively define the fourth, fifth and sixth fastening means. Each of these fastening means are strategically designed to complementally engage not only one another in certain mating fashions but also the recesses and vanes defining the first and second attachment areas on the main torso portion.

Stated succinctly, the humanoid figurine defining the construction toy of the instant invention uses the combined wedge, recess and vane structure of the earlier above mentioned pending patent application to provide all of the advantages associated therewith. Accordingly, the added associated benefits and advantages inherent in the instant application devolve from the foregoing features when taken in conjunction with the structure defining the head, the legs and the arms.

Specifically, the head includes a curved contour circumscribed within a peripheral ridge defining a first fastening means. The ridge is dimensioned to be received between adjacent wedges e.g. on the torso or where a similar groove or gap appears. Next, the legs are formed from two spaced pairs of substantially planar stock. Each pair is interrupted by a groove. The groove has a dimension corresponding to the thickness of the peripheral ridge of the head, for example, or the vanes of the major torso portion of the body. Thus, the groove or gap can interconnect other similar toy instrumentalities therewithin. Next, the arms which extend outwardly from the body also have the nominal thickness of the peripheral ridge defining the head. This means that the arms can be used as connectors in the same way that the vanes are utilized. In addition, a front portion of each of the arms includes a pair of forwardly extending spaced, locking ribs dimensioned to serve as the aforementioned groove or the recess between adjacent wedges for similar fastening purposes. A back face of the arm has a single, outwardly extending locking tab which operates similar to the vanes and the thickness of the head as further fastening means.

Succinctly stated, the instant invention spans the spectrum of complexity from a most simple toy to a most demanding, complex and creative toy to accommodate the interest pattern and skill level of the widest cross section of children and adults. The blocks themselves are capable of interconnection on all surfaces and and also capable of overlapping with adjacent blocks in a large number of patterns. The blocks themselves are also both optically ornate and of complex contour to provide both visual and tactile stimulus.

OBJECTS OF THE INVENTIONS

Accordingly, it is a primary object of the present invention to provide a novel and useful construction toy set.

A further object of the present invention is to provide a device as characterized above which is extremely simple to use thereby appealing to users having a modest skill level but also capable of manipulation by extremely creative people thereby spanning a broad spectrum in maintaining interest of users.

A further object of the present invention is to provide a device as characterized above which is both visually and tactilely stimulating.

It is yet a further object of the present invention is to provide a device as characterized above which is extremely durable in construction, safe to use and lends itself to mass production techniques.

A further object of the present invention is to provide a device as characterized above which is dimensioned such that even young children can safely play with blocks forming the construction toy set.

A further object of the present invention is to provide a device as characterized above where blocks can be interconnected in a multiplicity of ways, thereby promulgating creativity and providing an extremely large number of possible structures buildable with this construction set.

Viewed from one vantage point, it is an object of the present invention to provide a figurine construction toy which includes a front wall defining a first attachment surface and a rear wall having a second attachment surface where the first and second attachment surfaces define complemental connecting means. A top simulative head area extending up from the front and rear walls has a thickness defining a first fastening area by providing a further way to connect adjacent figurines or other attachment blocks of my above-referenced pending application. More particularly, the material defining the head has a peripheral ridge the thickness of which accommodates the space existing between adjacent wedges. Also two pairs of legs are oriented such that one first pair is spaced from the second pair by a gap. Each pair is formed from two planar stock elements spaced from each other by a groove. The groove defines a second fastening area and the gap defines a third fastening area. The fastening areas in effect are recesses between the pairs and function in the same way as the spaces between the wedges, with a dimension equal to the width of a groove adapted to receive either the head or vanes therewithin. Also the pair of arms extend outwardly from the major torso area and defines fourth, fifth and sixth fastening means. A front face of each arm includes a pair of spaced apart locking ribs where a space between the ribs corresponds to the groove mentioned above for the legs and the space between the wedges. A back surface of each arm provides a locking tab analogous to the thickness of the ridge on the head and having the dimension of the vanes. In addition, free ends of each arm form another peripheral lip and fastening area.

Viewed from a second vantage point, it is an object of the present invention to provide a human figurine construction toy which includes a torso, arms extending from the torso, legs extending from the torso, and a head extending from the torso all having fastening means on the figurine which attaches to another construction toy.

Viewed from a third vantage point, it is an object of the present invention to provide a construction toy which includes a wafer having a front wall, a rear wall and a periphery. Complemental attachment instrumentalities are provided on the front and rear walls and the periphery includes extensions emanating therefrom provided with plural fastening instrumentalities for attachment to other construction toys.

These and other objects will be made manifest when considering the following detailed specification when taken in conjunction with the appended drawing figures.

DESCRIPTION OF PREFERRED EMBODIMENTS

Figure 1:
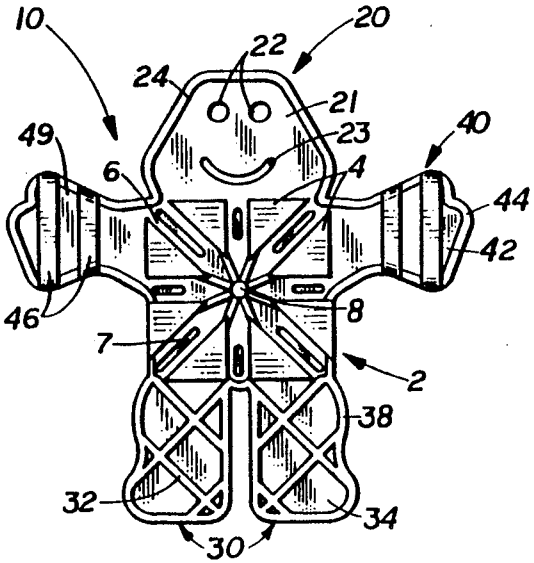
FIG. 1 is a front plan view of the apparatus according to the present invention.

Referring to the drawings now, where like numerals denote like parts, reference numeral 10 is directed to the humanoid figurine defining the construction toy of the instant invention.

In essence, the humanoid figurine 10 is a construction toy that is generally wafer-shaped. The toy can include a torso having a front wall 2 and a rear wall 12. Extending up from the torso is a head 20. Legs 30 extend from a portion of the torso opposite from the head. Arms 40 extend out from sides of the torso such that the figurine toy 10 generally approximates the external contour of the human physique but is suggestive of a robot-like creature.

More particularly, the figurine toy 10 and its torso includes a front wall 2 and a rear wall 12 which respectively define first and second attachment surfaces. These attachment surfaces are complemental, one to the other, so that a topographic outwardly projecting contour on one wall also defines a recess on an opposite wall. Thus, when the toy is formed from known plastic forming techniques, registry between a plurality of toys is assured so that the first and second attachment surfaces collectively define complemental connecting means. Generally, the torso portion approximates the structure of my co-pending application so that these humanoid figurines 10 can coact and connect with the blocks described therein.

Figure 2:
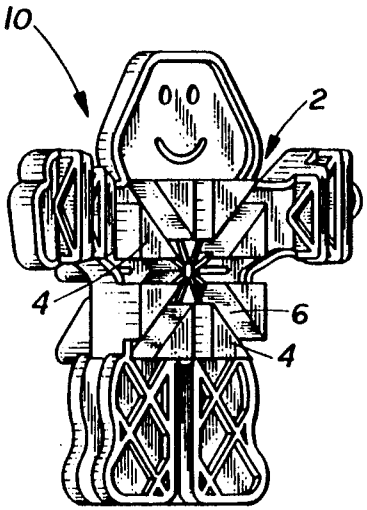
FIG. 2 is an oblique perspective of FIG. 1.

The front wall, shown in FIGS. 1 and 2 for example, include a plurality of wedges 4 emanating from a center 8. The center 8 includes spokes radiating towards apices of the wedges 4 which are nearest the center 8 of the torso. The wedges 4 define substantially right-angle triangles wherein a hypotenuse of each triangular wedge 4 is oriented along a diagonal of the substantially square-shaped torso. If the torso were viewed as a quadrilateral, wherein the number of sides N equals 4, 2N wedges are present. Spaces 6 are provided between adjacent wedges. These spaces 6 extend radially as shown in FIG. 1. Centrally disposed within each space 6 is a recess 7 extending more deeply into the torso than the spaces 6 extends. When viewing FIG. 4, these deeper recesses 7 appear as vanes 16 extending radially from a hub 18 of the rear wall 12.

More particularly, the rear wall 12 which defines the second attachment surface provides complemental connecting means with the first attachment surface defined by the front wall 2. The rear wall 12 includes a plurality of radially extending vanes 16 separated one from the other by a plurality of substantially triangular shaped spaces 14 having deeper recesses 17. Collectively, these deeper recesses 17 and the spaces 14 describe the wedges 4 which appear on the front wall 2 of FIG. 1. Thus, the vanes 16 are formed by both the spaces 6 and deeper recesses 7 of the front wall 2. Walls 2, 12 are thus assured of being stacked with respect to the connecting means defining the first attachment surface and the second attachment surface. The hub 18 is the inverse therefore of the center 8, and the spokes which emanate from the hub 18 are also the images converse to that which is shown in FIG. 1. Thus, each of the vanes extend radially. As before, since the torso is substantially quadrilateral shaped, 2N vanes 16 are provided emanating from the hub 18. Since N equals 4, eight vanes radially emanate, defining two cruciform sets, with one set occupying the diagonals of the rear wall 12 and the second set rotated 45 degrees therefrom providing substantially vertical and horizontal vanes when viewed in FIG. 4.

Thus formed, the torso portion bears striking similarity and shares most of the attributes of the blocks described in my co-pending application. As such, these blocks are quite compatible with the blocks described in my co-pending application as suggested in FIG. 6 which shows the figurine 10 interacting not only with other figurines 10, but also with blocks described in my co-pending application.

Figure 3:
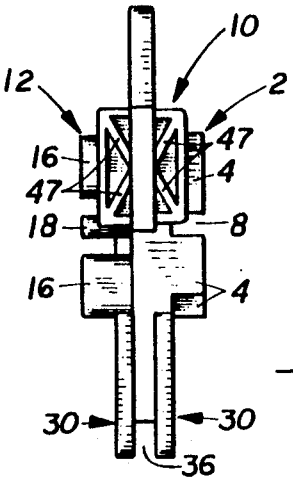
FIG. 3 is a side view of FIG. 1.

FIGS. 1 thru 5 also depict certain features inherent with the head portion 20 integrally formed with the humanoid figurine 10 and extending upwardly from the torso. In general, the head 20 emulates the facial expressions evocative of a human being. Thus, facial indicia such as eyes 22 and a mouth 23 are provided on a substantially planar surface 21 defining the head 20. The eyes 22 and the mouth 23 can be formed as apertures passing through the plastic, and the facial effect may be enhanced by raised projections or recesses on this portion of the head. A circumscribing peripheral ridge 24 denotes the outer boundary of the head 20. As shown, the head and its peripheral ridge 24 generally have a bulbous lower portion evocative of jowls adjacent what would constitute a neck in a humanoid figurine. The jowls taper inwardly upwardly and then a flattened top portion defines a top of the head 20. The peripheral ridge 24 and planar surface defining the head collectively provide a first fastening means since, as shown in FIG. 3, the width thereof is adapted to frictionally be retained within the spaces 6 on the front torso and on other areas to be defined. This first fastening means therefore allows plural toys to be interconnected.

Figure 4:
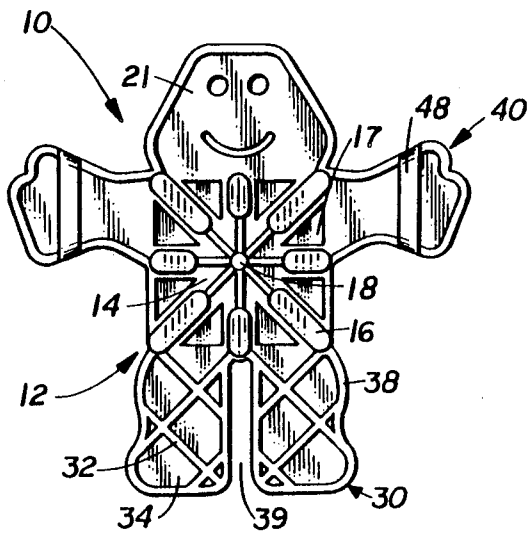
FIG. 4 is a rear plan view of FIG. 1.

In addition, a plurality of legs 30 extend downwardly from the torso to further enhance the impression of the figurine having human attributes. The legs 30 include planar stock portions 34 which are reinforced by webbing 32 which is raised up from the planar stock 34, enhancing the rigidity of the legs. In general, the legs are circumscribed by an outboard bead 38 having the same raised characteristics of the webbing 32. In essence, the legs 30 are provided in two pairs of planar stock 34 and associated webbing 32. A first pair of planar stock 34 defines a single leg in which the two planar stock portions 34 are separated one from the other by means of a groove 36, as shown in FIG. 3. Thus, for the sake of description, two "vertical" planar stock elements 34 are spaced apart in different vertical planes such that a groove 36 is provided having a clearance complemental to the thickness, for example, of a plurality of other types of connectors. This defines a second fastening means the clearance of which accommodates, for example the thickness of the peripheral ridge 24 of the head, and the width of the vanes 16 on the torso. A similar groove or gap 39 exists between one leg and the other, as shown in FIG. 4 for example. The clearance of groove or gap 39. like the groove 36, accommodates other toys for interconnection therebetween. Groove or gap 39 defines third fastening means. Thus, the first and second legs are spaced one from the other by means of a groove or gap 39. Each leg is formed from a pair of planar stock elements 34 and each leg extends from the torso. Thus a pair of legs, formed from a pair of planar stock elements 34 is provided. See FIG. 1 and FIG. 4.

Attention is now directed to the drawing figures which delineate certain structure with respect to the arms 40. In general, each arm 40 includes planar portion 42 emanating outwardly from the torso. The planar portion 42 is circumscribed by a peripheral lip 44. The general contour is simulative of an arm having a hand which, while lacking the definition of a hand in that no fingers are shown, has the contour of the hand were it to have worn a mitten. The peripheral lip 44 and the planar portion 42 collectively define a thickness as shown in FIG. 3 which is substantially identical to the thickness of the peripheral ridge 24 associated with the head 20. This means that the peripheral lip 44 and planar portion 42 define a fourth fastening means which can fit within the groove 36 (i.e. the second fastening means of the leg) or the grooves or gaps 39 (i.e. the third fastening means of the leg) as well as between the wedges 4 by fitting in the spaces 6.

The arms 40 also include a pair of spaced locking ribs 46 emanating from a "front" portion of the arm 40 as oriented in FIG. 1. The spaced locking ribs 46 are substantially vertically oriented planar ribs spaced apart such that a gap 49 is provided therebetween. As should now be evident, the gap 49 is chosen to provide a fifth fastening means because its width is complemental to the dimension of the vanes 16 on the back of the torso as well as the thickness of the head 20 defined by the peripheral ridge 24 and the other similarly dimensionally related structure previously enumerated. In addition, the arms 40 include a locking tab 48 directed rearwardly from the back of the arm as shown in FIG. 4. The locking tab 48 has the thickness of the peripheral ridge 24 of the head and therefore can be accommodated by the spaces 6 and groove 36, 39, gap 49 etc. The locking tab 48 and the locking ribs 46 as shown in FIG. 3 extend outwardly in a substantially vertical plane. They are provided with cruciform shaped reinforcement 47 to provide rigidity for these ribs 46 and tab 48. The tab 48 provides a sixth fastening means.

Figure 5:
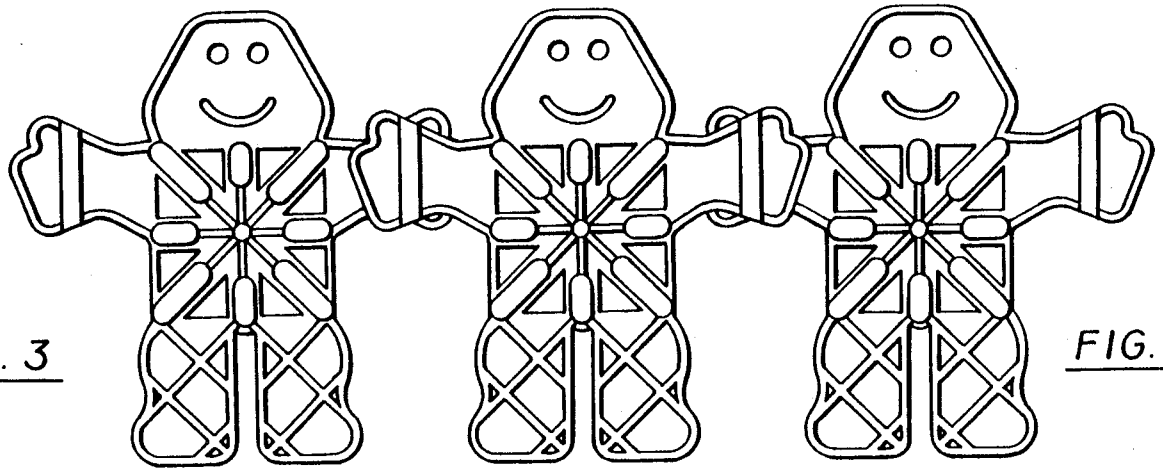
FIG. 5 shows plural FIG. 4 apparatus interconnected.
Figure 6:
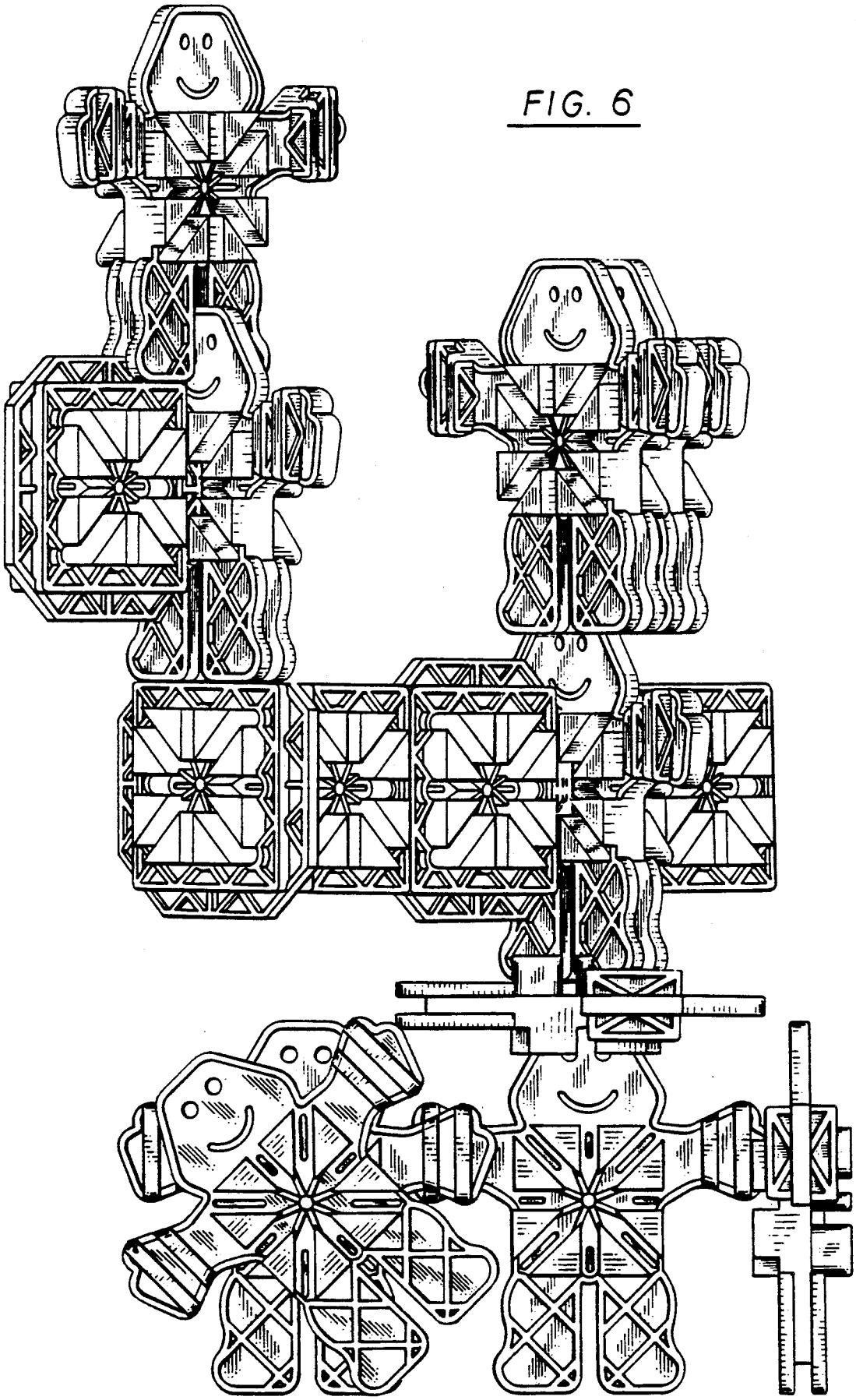
FIG. 6 reflects various orientations and connections of the apparatus with other like components.

In use and operation, the figurine 10 according to the present invention lends itself to deployment in a plurality of diverse manners, some of which are illustrated in FIGS. 5 and 6. As shown in FIG. 5, a series of figurines can be linked serially by "holding hands" with adjacent figurines oriented in different vertical planes by the interlocking relationship of the tabs 48 and locking ribs 46 defining respectively the sixth and fifth fastening means. In addition, the lower left hand corner of FIG. 6 reflects the "neutrality" inherent with the torso of the front and rear walls, 2, 12 of the instant invention and shared by the co-pending application. That is, because the wedges 4, spaces 6 and vanes 16 emanate radially from a center of the torso, they are a relatively neutral and allow rotation of the figurines, one with respect to another. Other attributes are illustrated in the drawing figures.

Moreover, having thus described the invention, it should be apparent that numerous structural modifications and adaptations may be resorted to without departing from the scope and fair meaning of the instant invention as set forth hereinabove and as described herein below by the claims.

I claim:

1. A figurine construction toy comprising, in combination:

a front wall defining a first attachment surface, a rear wall having a second attachment surface, said first and second attachment surfaces defining complemental connecting means, a top simulative head area extending up from edges between said front and rear walls, said head area having a thickness defining a first fastening means, two legs extending down from edges between said front and rear walls having means defining a second and third fastening means, and one pair of arms extending from edges between said front and rear walls having means defining fourth, fifth and sixth fastening means.

2. The toy of claim 1 wherein said first fastening means includes a planar portion extending upwardly, defining said head area and said planar portion is circumscribed by a peripheral ridge whose thickness defines said first fastening means, and facial indicia is carried on said portion including eyes and a mouth.

3. The toy of claim 1 wherein said second fastening means is located on each one of said legs and includes a groove on each one of said legs extending about a periphery of each one of said legs.

4. The toy of claim 1 wherein a pair of planar stock elements defining each one of said legs, and a groove extends between said planar stock elements.

5. The toy of claim 1 wherein one of said legs is spaced from the other said legs defining a gap which is said third fastening means.

6. The toy of claim 1 wherein said arms are each formed from planar stock material and said planar stock material is provided with a peripheral lip which defines said fourth fastening means.

7. The toy of claim 1 wherein each one of said arms includes a pair of spaced locking ribs projecting outwardly from a one side of each one of said arms, said spaced locking ribs including a gap therebetween defining said fifth fastening means.

8. The toy of claim 1 wherein each one of said arms includes a locking tab jutting outwardly therefrom, providing said sixth fastening means.

9. A human figurine type construction toy, comprising, in combination:

a wafer simulative of a human torso and having a front wall, a rear wall and a periphery, complemental attachment means on said front and rear walls, said periphery including plural extensions emanating therefrom which are simulative of human appendages and provided with plural fastening means for attachment to other construction toys.

10. The toy of claim 9 wherein two of said extensions simulate two arms formed from a planar stock material extending from said wafer and each one of said two extensions defining a major contour of one of each of said arms, and said planar stock material is provided with a peripheral lip which defines one of said fastening means.

11. The toy of claim 9 wherein one of said extensions simulates a head formed from planar stock material extending from said wafer, and said planar stock material is circumscribed by a peripheral ridge whose thickness defines one of said fastening means, and facial indicia are carried on said head including eyes and a mouth.

12. The toy of claim 9 wherein two of said extensions simulates two legs extending from said wafer and each one of said legs is provided with a groove circumscribing a periphery of each one of said legs defining one of said fastening means.

13. The toy of claim 9 wherein two said extensions simulate legs extending from said wafer and a gap extends between said two legs defining one of said fastening means.

14. The toy of claim 9 wherein two of said extensions simulate two arms having a pair of spaced, parallel locking ribs projecting outwardly from a one side of each one of said arms, said spaced locking ribs including a gap therebetween defining one of said fastening means.

15. The toy of claim 9 wherein two of said extensions simulate arms including a locking tab jutting outwardly from each of one said arms providing one of said fastening means.

16. An integrally formed human figurine construction toy comprising, in combination:

a torso having attachment means thereon to attach to another toy, arms extending from said torso, legs extending from said torso, a head extending from said torso, and plural fastening means on said figurine's each one of said arms, each one of said legs and head to attach to another construction toy, wherein said head comprises planar stock material extending from said torso, and said planar stock material is circumscribed by a peripheral ridge whose thickness defines one said fastening means, and facial indicia are carried on said head area including eyes and a mouth.

17. The toy of claim 16 wherein each one of said arms are formed from a planar stock material defining a major contour of each one of said arms, and said planar stock material is provided with a peripheral lip which defines one said fastening means.

18. The toy of claim 16 wherein each one of said legs extends from said torso and each one of said legs is provided with a groove circumscribing a periphery of each one of said legs defining one said fastening means.

19. The toy of claim 16 wherein each one of two said legs extends from said torso and a gap extends between said two legs defining one said fastening means.

20. The toy of claim 16 wherein each one of said arms includes a pair of spaced, parallel locking ribs projecting outwardly from a one side of each one of said arms, said spaced locking ribs including a gap therebetween defining one said fastening means.

21. The toy of claim 16 wherein each one of said arms includes a locking tab jutting outwardly from each one of said arms, providing one said fastening means.

* * * * *